US006116353A

United States Patent [19]

Leavell et al.

[11] Patent Number: 6,116,353

[45] Date of Patent: Sep. 12, 2000

[54] METHOD AND APPARATUS FOR INSTALLING A MICRO-WELL WITH A PENETROMETER

[75] Inventors: Daniel Adelbert Leavell, Vicksburg, Miss.; Landris Thomas Lee, Jr., Boulder, Colo.; Philip Garcin Malone, Vicksburg, Miss.; George Edward Robitaille, Jarrettsville, Md.

[73] Assignee: The U.S. Army Corps of Engineers as represented by the Secretary of the Army, Washington, D.C.

[21] Appl. No.: 09/047,397

[22] Filed: Mar. 25, 1998

[51] Int. Cl.[7] ..... E21B 49/08

[52] U.S. Cl. ..... 175/22; 175/20; 166/264; 73/864.74

[58] Field of Search ..... 175/20, 59, 60, 175/22; 166/264; 47/48.5; 73/864.74, 152.25, 863.23

[56] References Cited

U.S. PATENT DOCUMENTS

| | | | |
|---|---|---|---|
| 4,804,050 | 2/1989 | Kerfoot | 175/20 |
| 5,115,864 | 5/1992 | Gaidry et al. | 166/278 |
| 5,168,765 | 12/1992 | Broussard | 73/864.74 |
| 5,183,110 | 2/1993 | Logan et al. | 166/278 |
| 5,211,722 | 5/1993 | Wagner | 47/58 |
| 5,309,994 | 5/1994 | Douglas et al. | 166/278 |
| 5,320,178 | 6/1994 | Cornette | 175/19 |
| 5,487,431 | 1/1996 | Webb | 175/20 |
| 5,570,747 | 11/1996 | Cordry | 175/20 |
| 5,878,813 | 3/1999 | Ridgeway, Jr. | 166/162 |

*Primary Examiner*—William Neuder
*Assistant Examiner*—Zakiya Walker
*Attorney, Agent, or Firm*—Luther A. Marsh

[57] ABSTRACT

A well assembly device comprises an outer tubular sleeve with a first end and second end. An inner tubular member has a first end and a second end, and the inner tubular member is disposed within the outer tubular sleeve. The inner tubular member includes a screened portion at its second end. A tip is frictionally secured to the second end of the outer tubular sleeve, so that the outer tubular sleeve and the tip may selectively disengage.

13 Claims, 2 Drawing Sheets

METHOD AND APPARATUS FOR INSTALLING A MICRO-WELL WITH A PENETROMETER

STATEMENT OF GOVERNMENT INTEREST

The invention described and claimed herein may be manufactured and used by or for the Government of the United States of America for governmental purposes without the payment of royalties thereon or therefor.

FIELD OF THE INVENTION

The invention relates to a device for use with a civil engineering cone penetrometer. More specifically, this invention is directed to a direct-push micro-well installation device for installing a sand-filter-equipped and sealed, screened micro-well at a designated depth, and also to a method of installing the device.

BACKGROUND OF THE INVENTION

Groundwater monitoring wells were installed in the past by drilling a hole in the ground and lowering a slotted well casing into the hole. Filter material was then poured into the annulus between the hole and the well casing, to completely cover the slotted screen. A clay material was then placed above the filter material to effectively cap the filtermaterial. There have been a number of problems with these conventional techniques for installing groundwater monitoring wells. One problem is physical plugging of the screen, which oftentimes prevents fluid samples from entering the screened interval.

To counter this problem, other systems have been developed, including a preform which is installed directly into a bore hole as exemplified in U.S. Pat. No. 5,309,994. Contained within the preform are dry granular materials layered around the casing, and enclosed by an outer cylindrical sleeve. When the outer cylindrical sleeve is removed, the granular material disperses in ordered layers around the well casing in the bore hole. This technique avoids screen plugging, and ensures fluid sampling within the screened interval. However, these systems are slow and expensive to install. Bore hole must be drilled, and then a preform inserted. Thus, there is a need for a device which installs a sand-filter-equipped and sealed screened interval that can be used as a fluid monitoring well at any selected depth using direct-push technology, that is, technology which inserts a well assembly directly into the soil without having to drill a hole. Additionally, there is a need for installing smaller sized wells. Tools designed to be driven directly into the soil typically have smaller diameters than bits or augers which are used to drill a hole. Thus, a smaller well casing may be installed.

SUMMARY OF THE INVENTION

A principal object of the present invention is a monitoring well installation device, designed to allow its use specifically with direct-push equipment, such as a civil engineering cone penetrometer.

The above objects are achieved according to the present invention. A direct-push micro-well installation device includes an outer tubular sleeve, an inner tubular member with a screened portion disposed within the outer tubular sleeve, and a tip frictionally secured to the outer tubular sleeve so that the outer tubular sleeve and the tip may selectively disengage.

A method for installing a micro-well by direct-push equipment includes providing a well assembly including an inner tubular member disposed within an outer tubular sleeve, the outer tubular sleeve being frictionally secured to a tip, and the tip includes means for being secured in a subsurface strata, pushing the well assembly into the subsurface strata to a predetermined depth, disengaging the outer tubular sleeve from the tip, whereby the tip and inner tubular member remain engaged in the subsurface strata.

A device for centering a well casing for a direct push micro-well installation includes an outer tubular sleeve, an inner tubular member disposed within the outer tubular sleeve, and a plurality of radial vanes secured to and disposed about the inner tubular member for centering the inner tubular member within the outer tubular sleeve.

A cone for a penetrometer includes a conical member having a conical periphery and a cylindrical base. At least two barbs extend outwardly from the conical periphery.

These and other objects and advantages of the invention will be readily apparent in view of the following description and drawings of the above-described invention.

DESCRIPTION OF THE DRAWINGS

The above and other objects and advantages and novel features will become apparent from the following detailed description of the preferred embodiment of the invention illustrated in the accompanying drawings, wherein.

DESCRIPTION OF THE INVENTION

Figure 1:
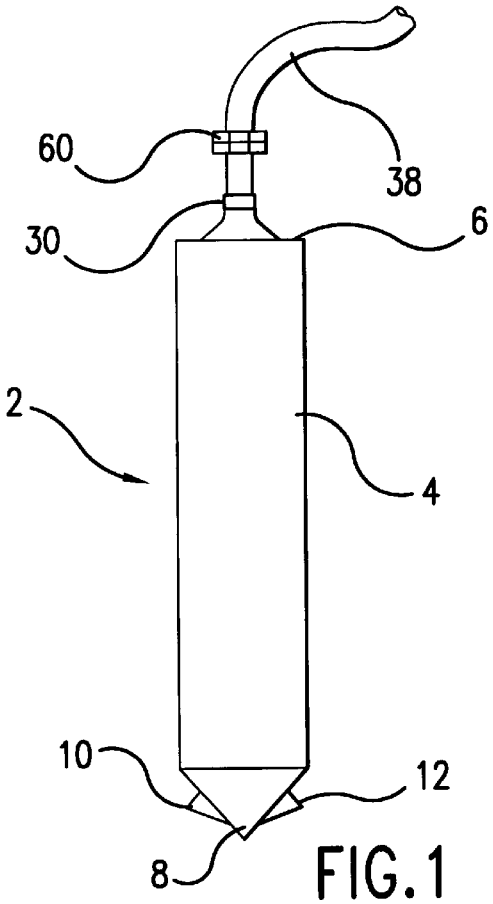
FIG. 1 is an elevational view of the invention.

As best shown in FIG. 1, well assembly 2 is to be installed by direct-push apparatus, such as a cone penetrometer. The use of direct-push technology obviates the need to drill a hole for installing a well assembly. Instead, for instance, a cone penetrometer forcibly deploys well assembly 2 directly into the soil. Well assembly 2 has an outer tubular sleeve 4, with a threaded end 6 located at its upper end to receive the direct-push apparatus. Because outer tubular sleeve 4 is pushed by force into a subsurface strata, then outer tubular sleeve 4 is a thick-walled, tubular member, preferably a steel cylinder, which provides strength. Attached to the lower end of outer tubular sleeve 4 is a tip 8 with diametrically opposed barbs 10 and 12.

Figure 2:
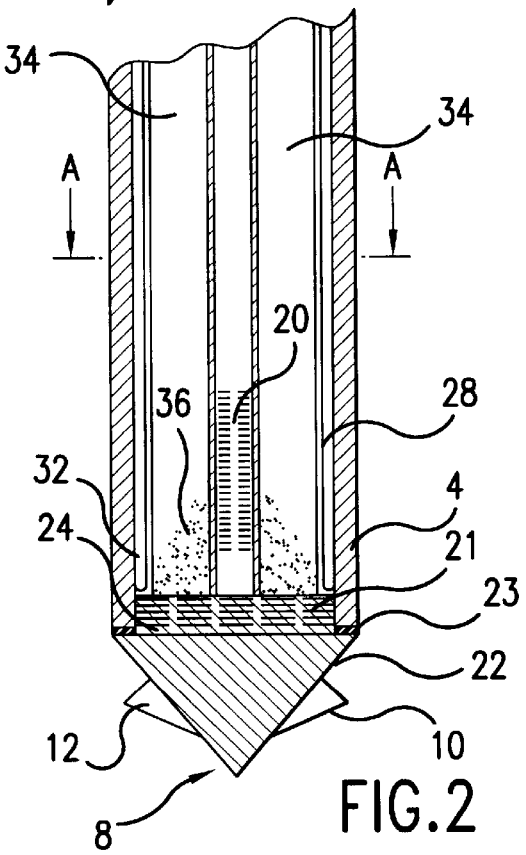
FIG. 2 is a fragmentary longitudinal cross-sectional view of a preferred embodiment.

A more detailed description of well assembly 2 is best shown in FIG. 2. Disposed within outer tubular sleeve 4 is inner tubular member 14, having an outer surface 16 and an inner surface 18. Inner tubular member 14 includes screened portion 20, preferably on its lower end to allow fluid to enter inner tubular member 14 so that sampling may take place. Inner tubular member 14 is fixedly secured to tip 8, such as by thread section (not shown). Tip 8 includes a cylindrical portion 21 extending coaxially from a conical periphery 22. The diameter of cylindrical portion 21 is smaller than the diameter of conical periphery 22 such that a flange portion 23 surrounds cylindrical portion 21. Tip 8 is shaped and sized so that cylindrical portion 21 fits inside outer tubular sleeve 4, while the base of outer tubular sleeve 4 is in contact with and presses against flange portion 23 of tip 8 when well assembly 2 is inserted into the soil. One or more O-rings 24 are installed on cylindrical portion 21 in order to frictionally secure tip 8 to outer tubular sleeve 4, while also providing a liquid seal as the assembly is advanced.

Extending from conical periphery 22 are diametrically opposed barbs 10 and 12, extending radially outwardly therefrom. Barbs 10 and 12 act to keep tip 8 embedded in the soil when outer tubular sleeve 4 is released from cylindrical portion 21 of tip 8. Because the barbs 10 and 12 extend outwardly into the strata, then the tip 8 will remain where positioned while the outer tubular member 4 is withdrawn.

Figure 5:
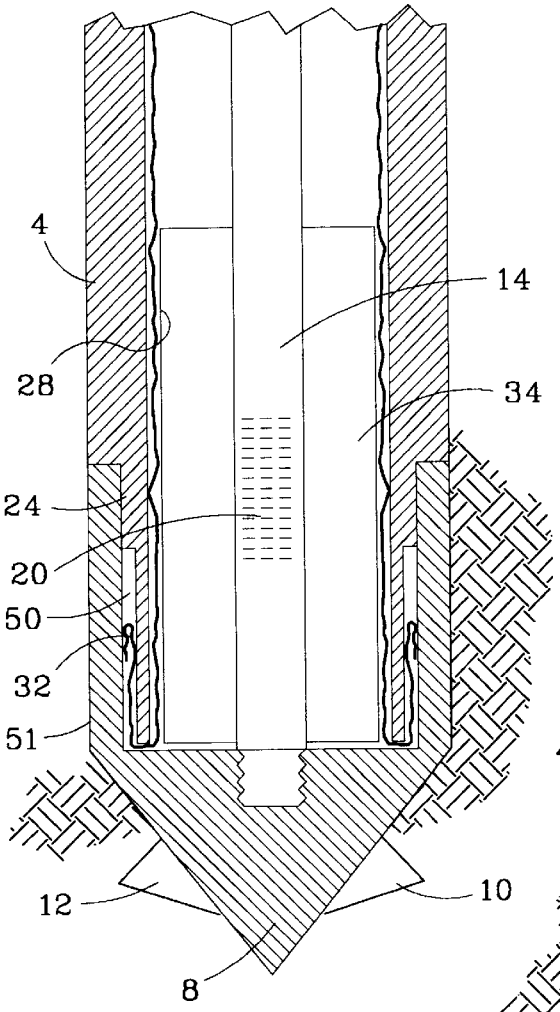
FIG. 5, is a detail cross-sectional view showing the flexible liner attachment in a alternate embodiment.

Disposed between outer tubular sleeve 4 and inner tubular member 14 is a flexible liner 28. Flexible liner 28 is attached to the inner surface 29 of outer tubular sleeve 4 at lower attachment 32. Flexible liner 28 is also attached to the outer surface 16 of inner tubular member 14 at upper attachment 30. Flexible liner 28 forms a sleeve or a sock, and is preferably made of fabric. Flexible liner 28 is made of the same material as disclosed in U.S. Pat. No. 5,309,994, the disclosure of which is incorporated herein by reference. However, the orientation of flexible liner 28 is different than in U.S. Pat. No. 5,309,994, so that the lower end of flexible liner 28 is attached to the inside (not the outside) of outer tubular sleeve 4. An outside attachment would be torn off as the unit is forced through the soil. In an alternate embodiment the flexible liner 28 may be attached to the outer surface of outer tubular member 4 by constructing a groove 50 in the outer surface that is covered by a cylindrical section 51 of tip 8 as shown in FIG. 5.

Vanes 34 are secured to outer surface 16 inner tubular member 14, and may be attached to the upper planar surface of cylindrical portion 21. Vanes 34 center the inner tubular member 14 within outer tubular sleeve 4, and prevent inner tubular member 14 from shifting as tip 8 disengages from outer tubular sleeve 4. Vanes 34 also add strength and rigidity to inner tubular member 14. Preferably there are four (4) vanes 34 equiangularly disposed about inner tubular member 14, all of which extend radially outwardly. Vanes 34 may be made of mete, and are fixedly secured to inner tubular member 14 by welding or the like.

Well assembly 2 must be prepared before insertion into subsurface strata. Flexible liner 28 is attached to lower attachment 32. The remainder of flexible liner 28 is placed over the inner surface 29 of outer tubular sleeve 4. Vanes 34 fit slidably inside flexible liner 28, and maintain inner tubular member 14 centered inside flexible liner 28 and outer tubular sleeve 4. Tip 8 is pressed into the lower end of outer tubular sleeve 4, and is frictionally held in place by O-rings 24 bearing against inner surface 29. Clean, size-graded, filter sand 36 is poured into flexible liner 28 through the open top of flexible liner 28. The quantity of filter sand 36 is poured into flexible liner 28 through the open top of flexible liner 28. The quantify of filter sand 36 is calculated so as to be sufficient to fill the volume of annular space 42 between the inner surface of the hole produced when outer tubular sleeve 4 is withdrawn from the soil and the outer surface 16 of inner tubular member 14. The filter sand 36, after outer tubular sleeve 4 is removed, should extend above the top of screened portion 20 of inner tubular member 14. A layer of dry, granular, expansive clay, for example, bentonite, is placed in flexible liner 28 above the filter sand 36. The top of flexible liner 28 is then gathered and loosely taped or tied to the top of inner tubular member 14 above vanes 34 at attachment point 30.

Figure 3:
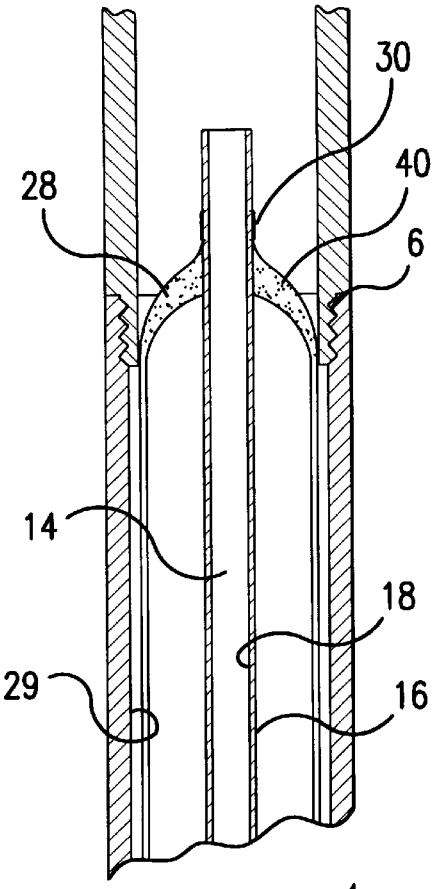
FIG. 3 is a cross-sectional view taken along line A–A$^1$ of FIG. 2 and viewed in the direction of the arrows.
Figure 3:
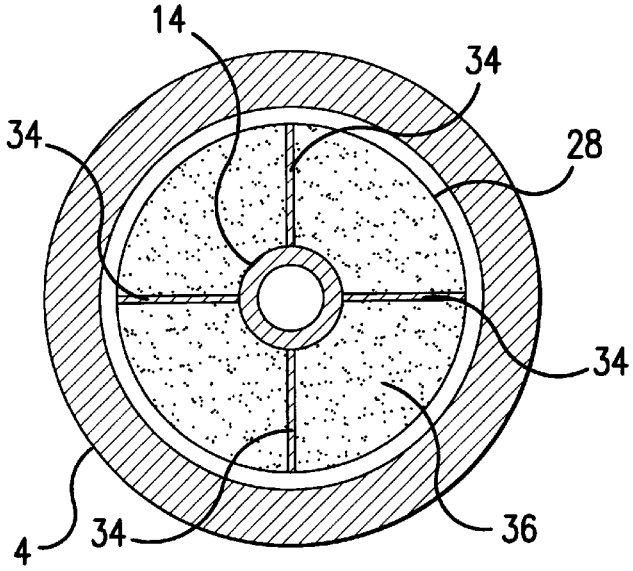

Vanes 34 are disposed about inner tubular member 14 and extend axially along outer surface 16 of inner tubular member 14. As best shown in FIG. 3, vanes 34 are disposed around inner tubular member 14. In a preferred embodiment, there are four (4) vanes. Disposed between vanes 34 and outer tubular sleeve 4 is flexible liner 28. Vanes 34 terminate proximate flexible liner 28 and outer tubular sleeve 4. Contained within flexible liner 28 is filter sand 36.

After well assembly 2 is constructed, the well installation device can be deployed. Referring to FIG. 1, flexible tube 38 is attached to upper attachment 30 of inner tubular member 14 and flexible tube 38 is threaded through successive sections of hollow penetrometer rod attached to threaded end 6. Tube 38 permits fluid to be transferred from the inside of inner tubular member 14 to the ground surface. Sufficient rod is provided to allow the well installation device to be placed at a designated depth. The well installation device is attached to the distal end of the penetrometer rod, at threaded end 6, and the installation device is pushed directly to a predetermined soil depth, with successive rod sections being added as necessary. This type of pushing operation is routinely done with geotechnical instruments to measure the strength of soil at designated depths.

Figure 4:
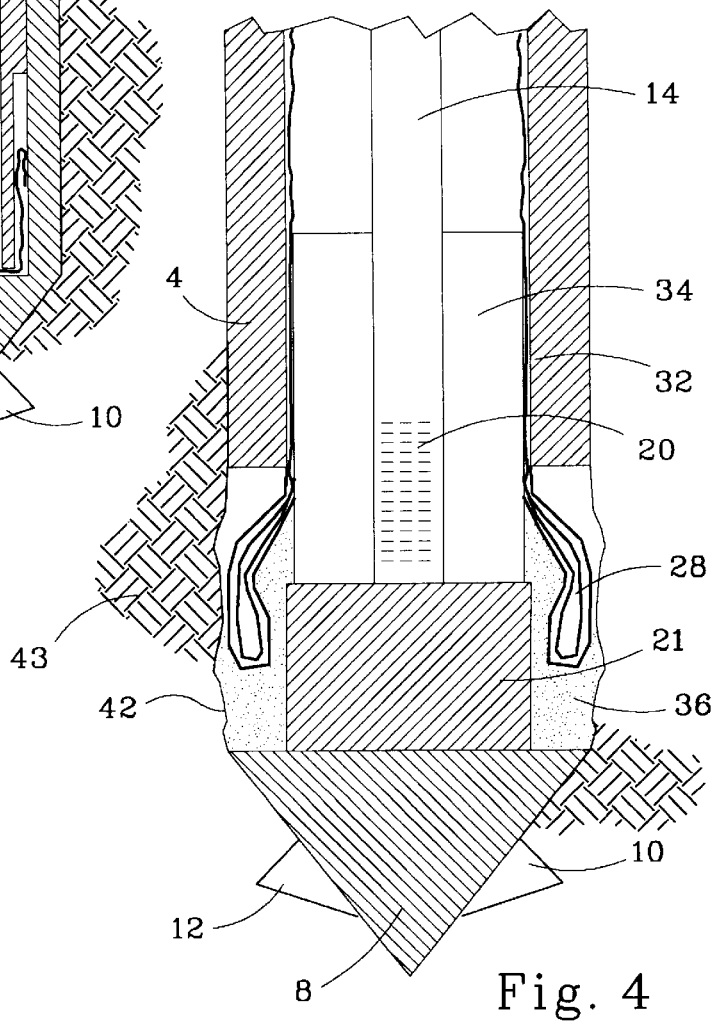
FIG. 4 is a fragmentary longitudinal cross-sectional view of a preferred embodiment illustrating the outer tubular sleeve and the partially dispensed filter material.

When the well installation device is at a suitable depth, the penetrometer rod attached to threaded end 6 and the rigidly attached outer tubular sleeve 4 are raised in an upward movement. Equipment attached to the penetrometer rod supplies the force which allows for outer tubular sleeve 4 to be detached from tip 8. As best shown in FIG. 4, tip 8, with barbs 10 and 12, is embedded thereby in the soils, and remains stationary. Inner tubular member 14 remains attached to tip 8. As the penetrometer rods are raised, the portion of flexible liner 28 attached to the lower end 32 of outer tubular sleeve 4 is also raised. Flexible liner 28 will evert and allow the sand and clay materials to flow unimpeded and without friction into the annular space left 42 created by the retracted penetrometer rods. The same filter sand 36 in flexible liner 28 flows into and occupies the space between the screened portion 20 of inner tubular member 14 and the soils 43. Sealing material 40 is also dispensed into the annular space 42 above filter sand 36. Sealing material 40 swells as it becomes wet, and produces a cap layer to seal the top of filter sand 36. As the penetrometer rods and outer tubular sleeve 4 are withdrawn to the surface, flexible liner 28, which is attached to upper attachment 30 of inner tubular member 14, is carried to the surface attached to outer tubular sleeve 4 at lower attachment 32. A small amount of clean water may be pumped or poured into the opening in the center of the penetrometer rods to assure that sealing material 40 is properly hydrated. After the penetrometer rods are withdrawn, the upper portion of the hole can be closed by grouting with a clay suspension or back-filled with clean soil, so as to fillin the space between flexible tube 38 running to the surface and the soil 43.

The connection of inner tubular member 14 to the ground surface may also be done by using sections of flexible tube 38. If rigid tubing 38 is used, sections of the tubing of a size compatible with inner tubular member 14 must be added as the penetrometer rods are forced into the soil, so that the flexible tube 38 forms a continuous passage between screened portion 20 and the ground surface. Upon a completion of penetrometer rod retraction, the annular space 42 between flexible tube 38 leading to the surface and the in-situ soil 43 can be filled with additional sealing material, such as grout, in a manner similar to that used for flexible tubing. The open upper end of flexible tube 38 leading to the surface may be capped, and then closed in a protective structure to complete the micro-well assembly 2 installation.

The disclosed penetrometer micro-well assembly 2 provides a means of installing a sand-filter-equipped and sealed-screened interval that can be used as a fluid monitoring well at any selected depth using direct-push technology, thus replacing the slower and more expensive conventional drilling technology. Providing a filtered and sealed screened interval allows accurate monitoring of soil fluids, with lower costs and provides samples of increased reliability. When installing monitoring wells with direct-push technology, the screened portion 20 may now be ensured to function properly by eliminating screen plugging, and by ensuring that the screened portion 20 allows for fluid sampling within a designated volume of soil. Physical plugging of screened portion 20 is avoided by providing an accurately placed sand filter sand 36 pack around the screened interval, and the desired sampling position is assured by accurate placement of the sealing material 40 above the sand filter 36 pack.

The micro-wells produced with this installation technique may be used to inject fluids into the ground, such as those used in chemical or biological treatment of groundwater. The technique assures accurate placement of fluids in the desired subsurface zones. This type of installation may also be used as a piezometer, groundwater-pressure measuring device.

While this invention has been described as having a preferred design, it is understood that it is capable of further modifications, uses, and/or adaptions of the invention following the general principle of the invention and including such departures from the present disclosure as come within known or customary practice in the art to which the invention pertains, and as may be applied to the central features hereinbefore set forth, and fall within the scope of the invention of the limits of the appended claims.

What is claimed is:

1. A well assembly device, comprising a. an outer tubular sleeve with a first end and second end;

b. an inner tubular member with a first end and second end, said inner tubular member disposed within said outer tubular sleeve and said inner tubular member includes a screened portion at its second end;

c. a flexible liner disposed between said outer tubular sleeve and inner tubular member, said outer tubular sleeve has an inner surface, said inner tubular member has an outer surface, said flexible liner is attached to said inner surface of said second end of said outer tubular sleeve and to said outside surface of said first end of said inner tubular member; and d. A tip frictionally secured to said second end of said outer tubular sleeve so that said outer tubular sleeve and said tip may selectively disengage.

2. The device of claim 1, wherein said inner tubular member includes means for centering said inner tubular member within said outer tubular sleeve.

3. The device of claim 2, wherein said centering means includes a plurality of vanes extending from said inner tubular member and terminating proximate said outer tubular sleeve.

4. The device of claim 3, wherein said vanes are radially disposed.

5. The device of claim 4, wherein said vanes extend axially along said inner tubular member.

6. The device of claim 5, wherein said vanes are secured to a cylindrical portion of said tip and said inner tubular member.

7. The device of claim 6, wherein at least one O-ring is disposed about the cylindrical portion of said tip for frictionally securing said tip to said outer tubular sleeve.

8. The device of claim 3, wherein said centering means includes four radial vanes extending from said inner tubular member and terminating proximate said outer tubular sleeve.

9. The device of claim 1, wherein a plurality of O-rings are disposed about said tip, said O-rings being coaxially aligned.

10. The device of claim 1, wherein said tip has a conical portion with at least one barb extending outwardly for causing said tip to be secured at a predetermined location after said outer tubular sleeve is disengaged from said tip.

11. The device of claim 1, wherein said outer tubular sleeve is a steel cylinder.

12. The device of claim 1, wherein said first end of said outer tubular sleeve is threaded.

13. The device of claim 12, further comprising a penetrometer rod with a distal end, said distal end of said penetrometer rod is secured to said threaded end of said outer tubular sleeve.

* * * * *